US009284092B2

(12) United States Patent
Boukobza

(10) Patent No.: US 9,284,092 B2
(45) Date of Patent: Mar. 15, 2016

(54) CONTAINER HAVING A BOTTOM WITH A CORRUGATED INTERNAL SEAT PORTION

(75) Inventor: Michel Boukobza, Octeville sur Mer (FR)

(73) Assignee: SIDEL PARTICIPATIONS, Octeville-sur-Mer (FR)

( * ) Notice: Subject to any disclaimer, the term of this patent is extended or adjusted under 35 U.S.C. 154(b) by 0 days.

(21) Appl. No.: 13/997,889

(22) PCT Filed: Dec. 26, 2011

(86) PCT No.: PCT/FR2011/053196

§ 371 (c)(1),
(2), (4) Date: Aug. 5, 2013

(87) PCT Pub. No.: WO2012/089982

PCT Pub. Date: Jul. 5, 2012

(65) Prior Publication Data

US 2013/0306588 A1 Nov. 21, 2013

(30) Foreign Application Priority Data

Dec. 29, 2010 (FR) ..... 10 05166

(51) Int. Cl.

| | |
|---|---|
| ***B65D 90/12*** | (2006.01) |
| ***B65D 6/16*** | (2006.01) |
| ***B65D 1/02*** | (2006.01) |
| ***B65D 79/00*** | (2006.01) |
| *B65D 90/02* | (2006.01) |

(52) U.S. Cl.
CPC ..... *B65D 11/18* (2013.01); *B65D 1/0276* (2013.01); *B65D 1/0284* (2013.01); *B65D 79/005* (2013.01)

(58) Field of Classification Search
CPC .. B65D 23/001; B65D 1/0261; B65D 1/0284; B65D 1/0276
USPC ..... 215/376, 374, 373
See application file for complete search history.

(56) References Cited

U.S. PATENT DOCUMENTS

| | | | | |
|---|---|---|---|---|
| 4,125,632 | A * | 11/1978 | Vosti et al. | 426/111 |
| 6,857,531 | B2 * | 2/2005 | Slat et al. | 215/382 |
| 7,451,886 | B2 | 11/2008 | Lisch et al. | |
| 8,596,029 | B2 * | 12/2013 | Pedmo et al. | 53/471 |
| 2006/0138074 | A1 * | 6/2006 | Melrose | 215/373 |
| 2007/0215571 | A1 * | 9/2007 | Trude | 215/373 |

(Continued)

FOREIGN PATENT DOCUMENTS

WO 2010/078341 A1 7/2010

*Primary Examiner* — Mickey Yu
*Assistant Examiner* — Niki Eloshway
(74) *Attorney, Agent, or Firm* — Sughrue Mion, PLLC

(57) ABSTRACT

Container (1) of plastic material, comprising a body (5) and a bottom (6), the bottom (6) having an annular outer seat (8) defining a principal seating plane (9) for the container (1), and a deformable membrane (10) that extends radially inside the annular outer seat (8) and is arranged to be able to adopt two configurations:

- a retracted configuration, in which the membrane (10) extends axially above the principal seating plane (9);
- a deployed configuration, in which the membrane (10) comprises an annular inner seat (14) in the form of an annular bead projecting towards the exterior of the container (1), which extends axially beneath the principal seating plane (9) and defines a secondary seating plane (15), the bottom (6) comprising a series of hollow reserves (20) in the annular inner seat (15) [sic], which form local discontinuities of the secondary seating plane (15).

8 Claims, 2 Drawing Sheets

(56) References Cited

U.S. PATENT DOCUMENTS

2007/0231530 A1 10/2007 Pedmo et al.
2010/0199611 A1* 8/2010 Pedmo et al. ..... 53/467
2010/0219152 A1* 9/2010 Derrien et al. ..... 215/374
2013/0043208 A1* 2/2013 Denner et al. ..... 215/376
2013/0180943 A1* 7/2013 Kurihara ..... 215/374

* cited by examiner

CONTAINER HAVING A BOTTOM WITH A CORRUGATED INTERNAL SEAT PORTION

The invention relates to the manufacture of containers, such as bottles or jars, obtained by blowing or stretch-blowing preforms made of thermoplastic material.

Conventional stretch-blowing induces a bi-orientation of the material (axial and radial) that gives good structural rigidity to the final container. However, the bi-orientation induces in the material residual stresses that, during hot filling (particularly with a liquid having a temperature above the glass transition temperature of the material), are released, causing a deformation of the container that could make it unfit for sale.

In order to minimize the deformations of the container during the retraction of the liquid accompanying its cooling after hot filling, it is known either to provide the body of the container with deformable panels that, during the cooling of the liquid, flex under the effect of the retraction, or to convey to the bottom the ability of the container to be deformed (or to be forcibly deformed).

The U.S. Pat. No. 7,451,886 (AMCOR) and international application WO 2009/050346 (SIDEL) both illustrate the technique of the deformable bottom: under the effect of the low pressure accompanying the retraction of the liquid, the bottom rises up towards the interior of the container.

The deformable bottom technique has, compared to the deformable panels technique, the advantage of minimizing the deformations of the body, particularly to the benefit of the aesthetic aspect of the container.

However, when the low pressure is too strong (for example when the fill temperature is high), the deformations of the bottom are insufficient to compensate for the variation in volume of the container, and the body is frequently undesirably (and uncontrollably) deformed as a result.

In order to increase the displacement of the bottom, it is known (see document WO 2006/068511, CO2PAC) to design the bottom so that it can adopt two positions separated from each other, to wit, a deployed position in which the bottom extends protruding to the exterior of the container, and a retracted position in which the bottom extends towards the interior of the container. The deployed position is adopted by the bottom before the container is filled, while the retracted position is adopted after the filling, in order to accompany the retraction of the liquid due to its cooling.

However, this technique assumes the return of the bottom from its deployed position to its retracted position. In order for this return to occur spontaneously, it is understandable that the low pressure in the container must be strong. Otherwise, the return does not occur, resulting in deformations on the body.

In order to avoid this situation, the document CO2PAC provides for forcing the changeover of the bottom from its deployed position to its retracted position by means of a tool by which pressure is applied on the bottom towards the interior of the container (see FIGS. 12*a* to 12*d*). This solution therefore assumes that such a tool be inserted in the manufacturing chain, at the expense of simplicity and rate of production.

Moreover, a container whose bottom comprises an annular structure provided with sequential formations (called teeth) is known from the document WO 2010/078341. This annular structure is supposed to form an articulation and uniformly distribute the stresses resulting from a cooling vacuum. However, in this design, the formation of the teeth (diamond-shaped) poses problems of blowability of the bottom, and in practice, it is necessary to use high blowing pressures to obtain the desired structure.

The invention therefore seeks to propose a container having a bottom that can be easily deformed (in particular without the need to use tools), and which has good blowability.

To that end, a container of plastic material is proposed, comprising a body and a bottom, the bottom having an annular outer seat defining a principal seating plane for the container, and a deformable membrane that extends radially inside the annular outer seat and is arranged to be able to adopt two configurations:

- a retracted configuration, in which the membrane extends axially above the principal seating plane;
- a deployed configuration, in which the membrane comprises an annular inner seat in the form of an annular bead projecting towards the exterior of the container, which extends axially beneath the principal seating plane and defines a secondary seating plane, the bottom further comprising a series of hollow reserves in the annular inner seat, which form local discontinuities of the secondary seating plane.

Configured in this way, the bottom has an increased deformability under the effect of low pressure in the filled container, while enabling easy transport of the empty container resting on the inner seat, and still having good blowability.

Preferably, the inner seat comprises an internal section and a truncated cone-shaped external section, joined at the inner seat, and the hollow reserves form a junction between the internal and external sections through the inner seat.

Each hollow reserve extends, for example, over an angular extension J such that:

$$\frac{360}{2n} - 10 \leq J \leq \frac{360}{2n}$$

where n is the number of reserves on the bottom, and J is the angular extension of each reserve expressed in degrees.

According to one embodiment, each hollow reserve extends over an angular extension substantially equal to an angular extension of a section of arc of the inner seat situated between two successive hollow reserves.

Preferably, each hollow reserve extends radially over an extension greater than the width of the inner seat.

Advantageously, each hollow reserve extends radially over an extension of between one-seventh and one-third of the diameter of the inner seat.

For example, each hollow reserve is in the shape of a horse saddle and has a double curvature.

Other objects and advantages of the invention will be seen from the following description, provided with reference to the appended drawings in which.

Figure 1:
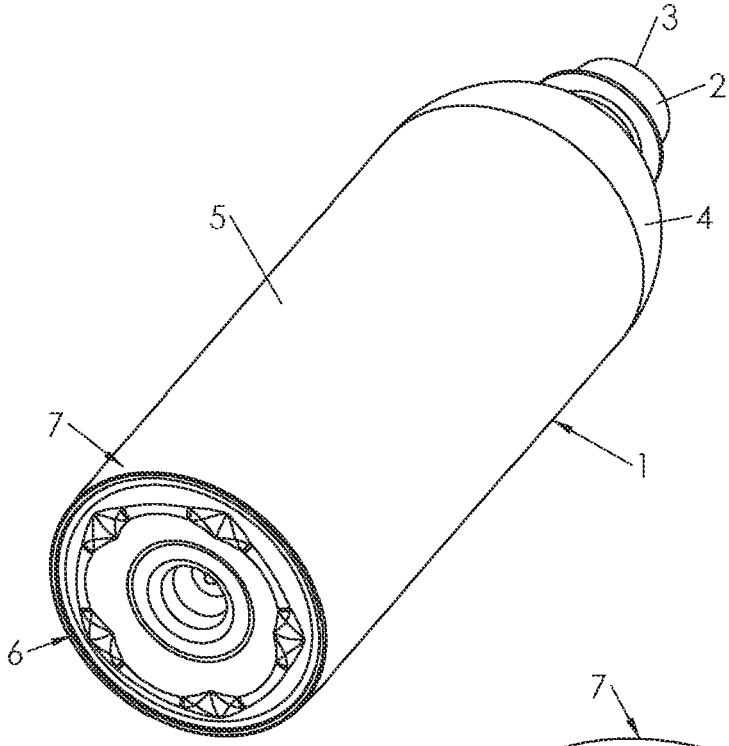
FIG. 1 is a view in perspective from below of a container according to the invention.

Represented in the figures is a container 1—in this instance, a bottle—produced by the stretch-blowing of a preform made of thermoplastic material such as PET (polyethylene terephthalate), previously heated to a temperature above the glass transition temperature of the material.

Said container 1 is preferably of the heat-resistant (HR) type; in this case, it can be manufactured by stretch-blowing in a mold whose wall is heated so as to increase the rate of crystallinity of the material by calorific input.

Said container 1 comprises, at an upper end, a threaded neck 2, provided with a mouth 3. In the extension of the neck 2, the container 1 comprises in its upper part a shoulder 4 extended by a lateral wall or body 5, which has an overall shape that is symmetrical in revolution around principal axis X of the container 1.

The container 1 further comprises a bottom 6 that is extended at a lower end of the container 1 in the extension of the body 5.

The body 5 is, in a lower part, substantially cylindrical and is extended downwards to a lower end 7 where it joins the bottom 6.

The bottom 6 comprises, in the axial extension of the junction 7, an external seat 8 in the form of an annular bead, which defines a principal seating plane 9 for the container 1, by which said container can be placed flat on a flat surface such as a table.

The bottom 6 further comprises a membrane 10 that is extended radially from the external seat 8 towards the axis X of the container 1, to a central region 11 of the bottom 6, comprising successively, radially from the exterior towards the interior, a substantially flat annular central section 12 that is perpendicular to the axis X, then, at the center of the bottom 6 in the extension of the section 12, a pin 13 protruding axially towards the interior of the container 1.

The membrane 10 is deformable, being arranged to be able to adopt two configurations:

- a deployed configuration, represented by solid lines in the figures, in which the membrane 10 is extended at least in part beyond (or below, when the container is oriented neck upwards) the principal seating plane 9—in other words, projecting towards the exterior of the container 1,
- a retracted configuration, represented by broken lines in the cross-section of FIG. 5, in which the membrane 10 is extended axially below (or above, when the container is oriented neck upwards) the principal seating plane 9—in other words, projecting towards the interior of the container 1, thus forming an arch substantially in the shape of a truncated cone.

The container 1 is formed in the deployed configuration of the membrane 10. In this position, the membrane 10 comprises an annular bead projecting towards the exterior of the container, forming an annular inner seat 14, which extends axially beyond (or below) the principal seating plane 9 and defines a secondary seating plane 15 by which the container can be placed flat on a flat surface (particularly on a conveyor belt when exiting the mold). The diameter of the secondary seating plane (shown by broken lines in FIG. 3) is indicated as A, and the distance measured axially between the principal seating plane 9 and the secondary seating plane 15 (FIG. 5) is indicated as B.

The outer seat 8 is internally bordered by an annular step 16 that extends axially over a small height, followed by an annular return 17 that, in the deployed position of the membrane 10, extends radially in a plane substantially perpendicular to the axis X.

Figure 5:
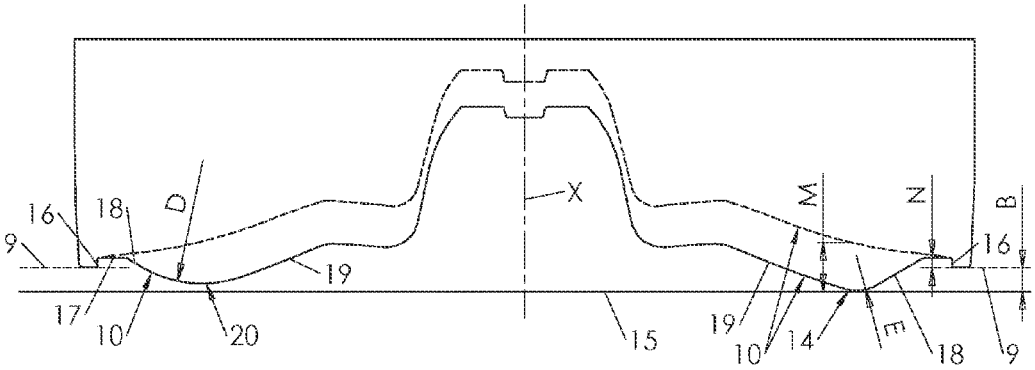
FIG. 5 is a cross-sectional view of the bottom of FIG. 3, along cutting plane V-V.

As can be clearly seen in FIG. 5, the membrane 10 comprises:

- an external truncated cone-shaped section 18, which extends radially inward from the return 17, and axially outwards (i.e., downwards) to the inner seat 14;
- an internal section 19, also truncated cone-shaped, which extends radially outwards from the annular central section 12, and axially outwards (i.e., downwards) to the inner seat 14, which thus forms a connection fillet between the outer section 18 and the inner section 19, the concavity turned upwards.

The inner seat 14 thus forms the most protruding part (i.e., the lowest) of the membrane 10.

Figure 2:
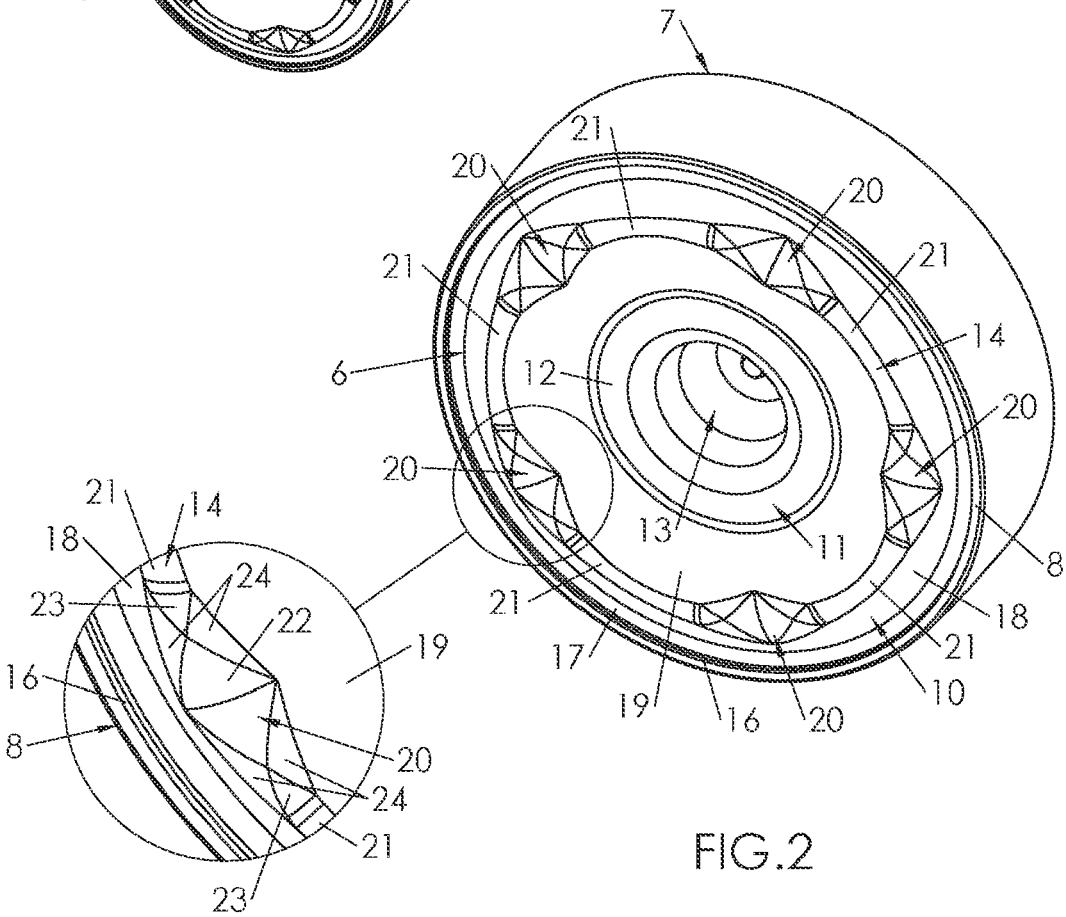
FIG. 2 is a view in larger scale of the bottom of the container of FIG. 1.
Figure 3:
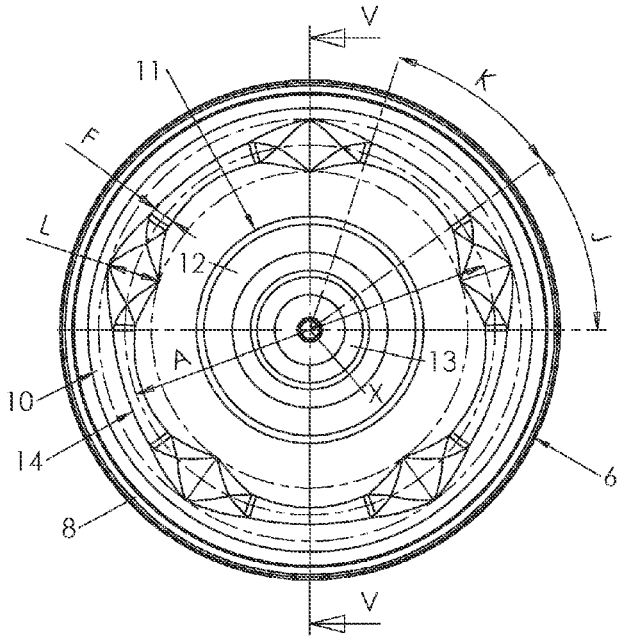
FIG. 3 is a plan view from below of the bottom of FIG. 2.

As can be clearly seen in the figures, particularly in FIGS. 2 and 3, the bottom 6 comprises a series of hollow reserves 20 formed in the inner seat 14.

The reserves 20 extend radially astride the inner seat 14, and form a junction between the outer section 18 and the inner section 19 of the membrane 10 through the seat 14.

The principal function of the hollow reserves 20 is to allow a progressive, flexible return of the membrane 10 from its deployed configuration (adopted upon completion of the forming in the mold, and preserved during any transport of the container 1, then during the filling thereof), to its retracted configuration (adopted under the effect of a low pressure in the container 1 accompanying the cooling of the contents after capping).

Figure 4:
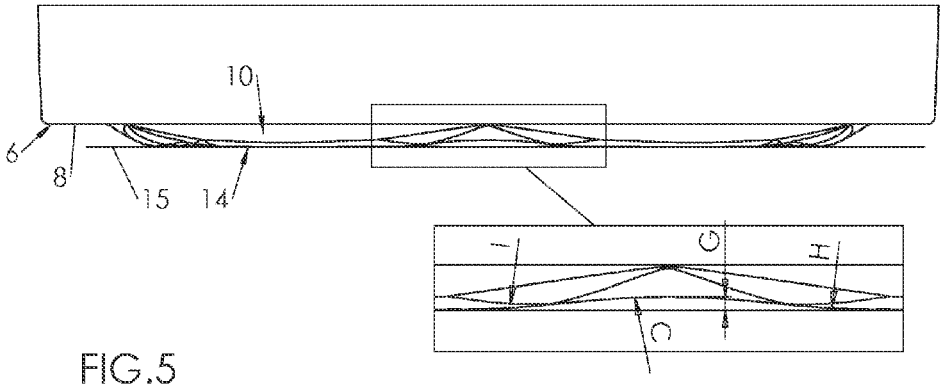
FIG. 4 is a side view of the bottom of FIG. 3, represented placed on a flat surface.

Each reserve 20 has the overall shape of a horse saddle, and consequently has a double curvature, to wit:

- viewed from the side, a first curvature with concavity oriented downwards, having a radius denoted as C (seen at the center in FIG. 4),
- in radial cross-section, a second curvature with concavity oriented upwards, having a radius denoted as D (seen at the left in FIG. 5), The hollow reserves 20 thus form undulations in the inner seat 14, which generate local discontinuities of the secondary seating plane 15. The secondary seating plane 15 is consequently formed from a discrete series of sections 21 of coplanar arcs at the end of the inner seat 14, which extend between the hollow reserves 20 and whose radius of curvature is denoted as E (FIG. 5, at the right), which is consequently the radius of curvature of the inner seat 14 at the secondary seating plane 15. Furthermore, F denotes the width of the inner seat 14, i.e., the width (measured radially at the sections 21 of arc) of the junction between the outer section 18 and the inner section 19 of the membrane 10, where the radius of curvature is constant and equal to E.

G denotes the depth, measured axially, of each hollow reserve 20 (i.e., the distance, measured axially, from the bottom of each reserve 20 to the secondary seating plane 15).

Each reserve 20 comprises a central zone 22, the contour of which, viewed from below in the axial direction (FIG. 3), is diamond-shaped, and which has the double curvature mentioned below. The junction of said central zone 22 with the adjacent sections of arc 21 is accomplished by means of connection fillets 23 with concavity oriented upwards, and whose radius of curvature, denoted as H, is comparable to the radius C (in absolute value). The junction of the central zone 22 with the outer and inner sections 18, 19 of the membrane 10 is accomplished by means of connection fillets 24 with concavity oriented upwards, and whose radius of curvature, denoted as I, is comparable to the radii C and D, while slightly less in absolute value.

J denotes the angular extension of each reserve 20 and K denotes the angular extension of the sections of arc 21, both measured in the secondary seating plane 15 around the axis X.

The number n of reserves 20 is preferably between 3 and 7, and the angular extension J (expressed in degrees) preferably verifies the following inequality:

$$\frac{360}{2n} - 10 \leq J \leq \frac{360}{2n}$$

According to an embodiment illustrated in FIG. 3, the angular extension J of the reserves 20 is comparable to the angular extension K of the sections of arc 21. The angular extensions J, K are preferably substantially equal. In the illustrated embodiment, where the bottom 6 comprises five hollow reserves 20 (n=5) distributed uniformly over the perimeter of the inner seat 14, the angular extensions J and K are approximately 35°.

Furthermore, L denotes the radial extension of the hollow reserves 20. Said extension L is greater than the width F of the seat (and preferably even greater than or equal to three times the width F of the seat); moreover, the extension L is preferably between one-seventh and one-fourth of the diameter A of the inner seat 14. In the embodiment illustrated in FIG. 3, L is approximately equal to one-sixth of the diameter A.

It will be noted that the lines visible in the figures are intended to better suggest the contour of the reserves 20 (and more particularly the central zones 22 and connection fillets 23, 24 that frame them), but do not in any way indicate that there is a discontinuity between these different zones 22, 23, 24. The presence of sharp edges would result in promoting the appearance of cracks during the return of the membrane by introducing strong local variations of the curvature of the material in the vicinity of the inner seat. This problem is avoided as a result of the hollow reserves 20 whose variations of curvature are progressive, which further improves the blowability of the container.

FIG. 5 shows that the displacement of the membrane 10 in its return from its deployed configuration (shown in solid lines) to its retracted configuration (in broken lines), measured at the inner seat, is relatively large. More specifically, said displacement, denoted M, is substantially equal to twice the distance B between the two seating planes 9, 15, or preferably twice the sum of the distance B and the height, denoted N, of the step 16. Said large displacement M is allowed by the configuration of the membrane 10, and more particularly the progressivity of its return induced by the shape and dimensions of the hollow reserves 20.

Said large displacement makes it possible to avoid as much as possible the occurrence of deformations on the body 5 accompanying the decrease of internal volume of the container 1 due to the cooling of the liquid and of the air present in the headspace (defined as the space between the liquid and the cap closing the container 1).

To manufacture the container 1 that has just been described, the stretch-blowing technique in a mold will preferably be used, said mold comprising a sidewall defining a lower opening and a mold bottom that is movable with respect to the wall of the mold between:

a lower position, adopted at the beginning of the blowing, in which the mold bottom is separated downwards from the opening, and an upper position, adopted at the end of blowing, in which the mold bottom blocks the opening and pushes up the material of the bottom 6 of the container 1.

This technique, called boxing, makes it possible to increase the stretching rate of the bottom, to the benefit of its mechanical rigidity, and also to facilitate the imprinting of the membrane 10, particularly at the hollow reserves 20.

The invention claimed is:

1. Container of plastic material, comprising a body and a bottom, the bottom having an annular outer seat defining a principal seating plane for the container, and a deformable membrane that extends radially inside the annular outer seat and is arranged to be able to adopt two configurations:

a retracted configuration, in which the membrane extends axially above the principal seating plane;

a deployed configuration, in which the membrane comprises an annular inner seat in the form of an annular bead projecting towards the exterior of the container, which extends axially beneath the principal seating plane and defines a secondary seating plane, and the bottom comprises a series of hollow reserves in the annular inner seat, the reserves extending radially astride the annular inner seat, which form local discontinuities of the secondary seating plane, the secondary seating plane being formed from a discrete series of sections of coplanar arcs at the end of the inner seat, which extend between the hollow reserves; and wherein the reserves have a central zone and connection fillets with adjacent sections of coplanar arcs, the central zone having a double curvature, a first curvature, viewed from the side, with concavity oriented downwards, a second curvature in radial cross section, with concavity oriented upwards.

2. The container according to claim 1, characterized in that the inner seat comprises an external section and a truncated cone-shaped internal section, joined at the inner seat, and in that the hollow reserves form a junction between the external section and the internal section through the inner seat.

3. The container according to claim 1, characterized in that each hollow reserve extends over an angular extension J such that:

$$\frac{360}{2n} - 10 \leq J \leq \frac{360}{2n}$$

where n is the number of reserves on the bottom, and J is the angular extension of each reserve expressed in degrees.

4. The container according to claim 1, characterized in that each hollow reserve extends over an angular extension J substantially equal to an angular extension of a section of arc of the inner seat situated between two successive hollow reserves.

5. The container according to claim 1, characterized in that each hollow reserve extends radially over an extension greater than the width of the inner seat.

6. The container according to claim 1, characterized in that each hollow reserve extends radially over an extension of between one-seventh and one-third of the diameter of the inner seat.

7. The container according to claim 1, characterized in that each hollow reserve is in the shape of a horse saddle.

8. A container of plastic material, comprising:

a body and a bottom;

the bottom comprising an annular outer seat defining a principal seating plane for the container, and a deformable membrane extending radially inside the annular outer seat and structured to adopt a retracted configuration, in which the membrane extends axially above the principal seating plane; and a deployed configuration, in which the membrane comprises an annular inner seat in the form of an annular bead projecting towards the exterior of the container, which extends axially beneath the principal seating plane and defines a secondary seating plane;

the bottom further comprises a series of hollow reserves in the annular inner seat, the reserves extending radially across the annular inner seat forming local discontinuities of the secondary seating plane such that the secondary seating plane is not continuous and defined by a discrete series of discontinuous coplanar arcs that extend between the hollow reserves; and wherein the reserves have a central zone and connection fillets with adjacent sections of the coplanar arcs, the central zone having a double curvature, a first curvature, viewed from the side, with concavity oriented downwards, a second curvature in radial cross section, with concavity oriented upwards.

* * * * *